US006001027A

United States Patent [19]

Hansberger

[11] Patent Number: 6,001,027

[45] Date of Patent: Dec. 14, 1999

[54] METALWOOD GOLF CLUB

[75] Inventor: James R. Hansberger, Melrose Park, Ill.

[73] Assignee: Teardrop Ram Golf Company, Morton Grove, Ill.

[21] Appl. No.: 08/697,647

[22] Filed: Aug. 27, 1996

[51] Int. Cl.[6] ..... A63B 53/02; A63B 53/04

[52] U.S. Cl. ..... 473/306; 473/345

[58] Field of Search ..... 473/324, 345, 473/346, 349, 350, 305, 306, 307, 308, 309, 310, 312

[56] References Cited

U.S. PATENT DOCUMENTS

| | | | |
|---|---|---|---|
| 2,129,068 | 9/1938 | Reach | 473/306 |
| 3,170,691 | 2/1965 | Pritchard | 473/306 |
| 4,438,931 | 3/1984 | Motomiya | 473/346 |
| 5,028,049 | 7/1991 | McKeighen | 473/345 |
| 5,039,098 | 8/1991 | Pelz | 473/312 |
| 5,090,702 | 2/1992 | Viste | 473/331 |
| 5,232,224 | 8/1993 | Zeider | 473/345 |
| 5,433,442 | 7/1995 | Walker | 473/307 |
| 5,454,563 | 10/1995 | Nagamoto | 473/312 |
| 5,485,998 | 1/1996 | Kobayashi | 473/309 |
| 5,556,097 | 9/1996 | Endo | 473/309 |

*Primary Examiner*—Sebastiano Passaniti

[57] ABSTRACT

A metalwood golf club comprising a head and a shaft, the head consisting of a four-piece construction including a crown plate having a top wall defining a front edge, side edges and a rear edge. The head includes a sole plate having a bottom wall, upwardly extending side and rear walls, upper edges of the side and rear walls attached to the respective side and rear edges of the crown plate, front edges defined by the sole late bottom wall and side walls, the combination of the sole plate bottom wall and the crown plate defining an open front for the head. Further, the head includes a front plate defining the ball-striking face of the head attached to said crown plate and sole plate front edges. A hosel is attached to the assembly of the plates.

4 Claims, 2 Drawing Sheets

METALWOOD GOLF CLUB

BACKGROUND OF THE INVENTION

This invention relates to golf clubs and in particular to longer distance clubs taking the form of metalwoods.

All golf clubs were initially formed with heads made of wood. A great deal of effort and expense was required to select wood which was strong, resilient and free of defects. The clubs were formed in as precise a relationship with the grain as possible to take maximum advantage of properties from the standpoints of performance and durability.

Eventually, the heads of shorter distance clubs were formed of metal and, even though various types of metal alloys and forming techniques have been used, such clubs to this day are referred to as "irons". One advantage over wood clubs is that irons can be produced with greater precision and consistency so that performance characteristics could be more readily controlled.

More recently, metal has also been used for making the heads for longer distance clubs. Because such clubs were traditionally known as "woods" to distinguish them from irons, the metal versions have been referred to as "metalwoods".

As with irons, precision manufacturing and consistency were among the reasons metalwoods were adopted. Furthermore, emphasis has been placed on using strong but lightweight metals so that performance could be optimized.

Most recently, the use of titanium alloys has become popular for manufacturing all or part of the metalwood heads. Thus, certain titanium alloys are known to have a high strength to weight ratio and are well adapted to this application.

SUMMARY OF THE INVENTION

This invention relates to a novel metalwood golf club head structure and to the method for producing that structure. The invention is particularly applicable to metalwoods formed of titanium alloys.

The golf club head structure of the invention comprises a four-piece construction including:

a) A crown plate having a top wall defining a front edge, side edges and a rear edge.

b) A sole plate having a bottom wall and upwardly extending side and rear walls. The upper edges of these side and rear walls are attached to the respective side and rear edges of the crown plate. The combination of the sole plate bottom wall and the crown plate define an open front for said head.

c) A front plate defining the ball-striking face of the head which is attached to the front edges of the crown plate and sole plate.

d) A hosel which is attached to the assembly of the plates.

DESCRIPTION OF THE PREFERRED EMBODIMENTS

Figure 1:
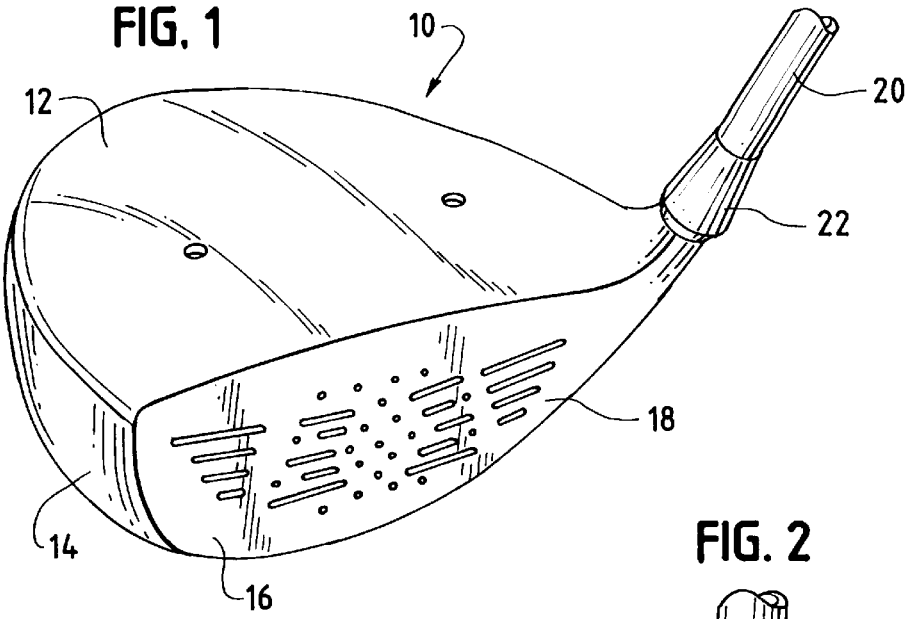
FIG. 1 is a fragmentary perspective view of a metalwood golf club produced in accordance with this invention.
Figure 2:
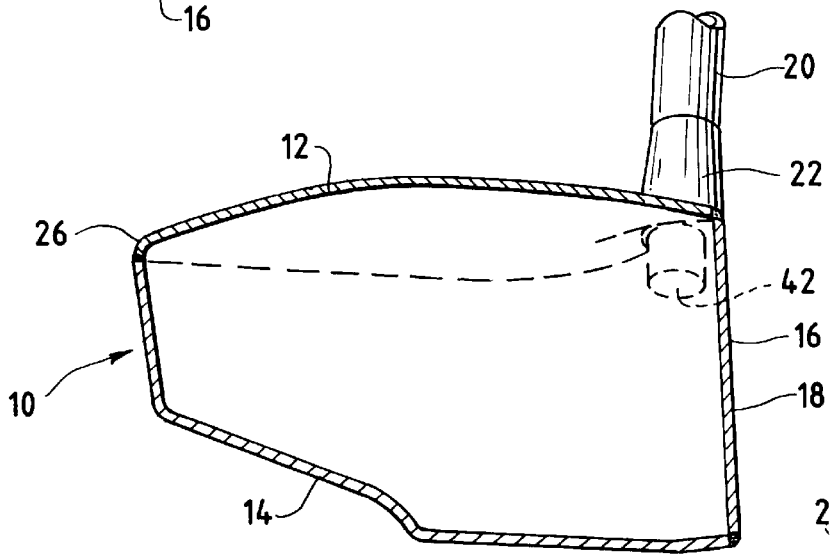
FIG. 2 is a vertical sectional view of the club taken in the direction from the club face to the rear side thereof.
Figure 3:
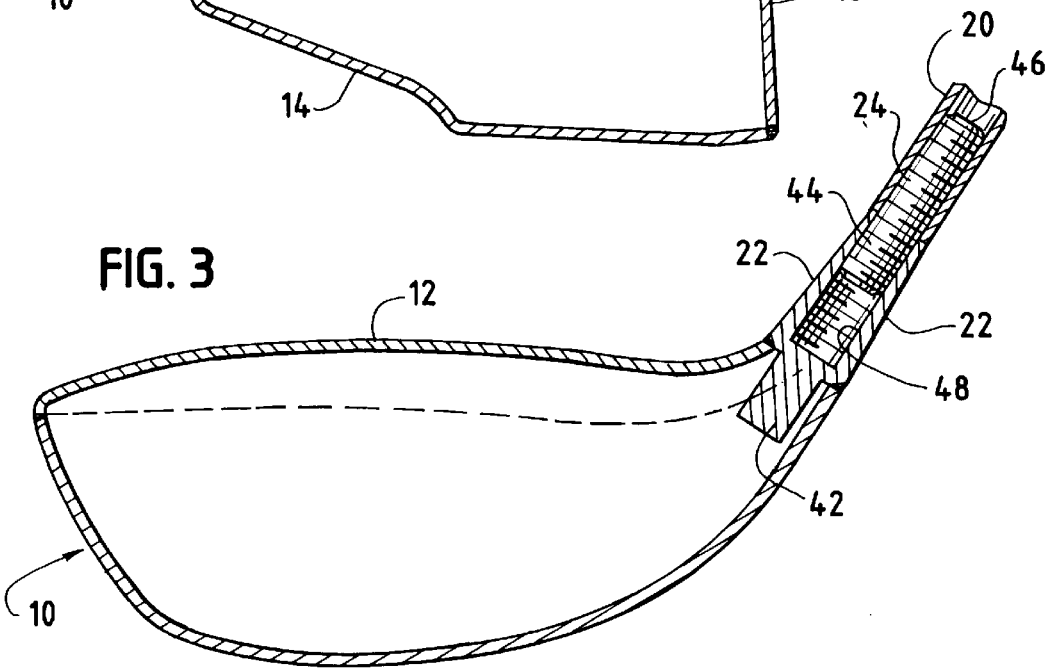
FIG. 3 is a vertical section of the club taken in the direction from heel to toe; and, FIG. 4 is an exploded view illustrating the various components of the club.

FIGS. 1–3 illustrate a metalwood golf club head 10. The invention is particularly applicable to a driver or No. 1 wood but is also intended for application to all other forms of metalwoods.

The golf club head 10 includes a crown plate 12, a sole plate 14 and a front plate 16 which defines the striking face 18 of the club. The head is supported on shaft 20 and a hosel 22 serves, in combination with a stabilizing pin 24, to connect the shaft to the head 10.

Figure 4:
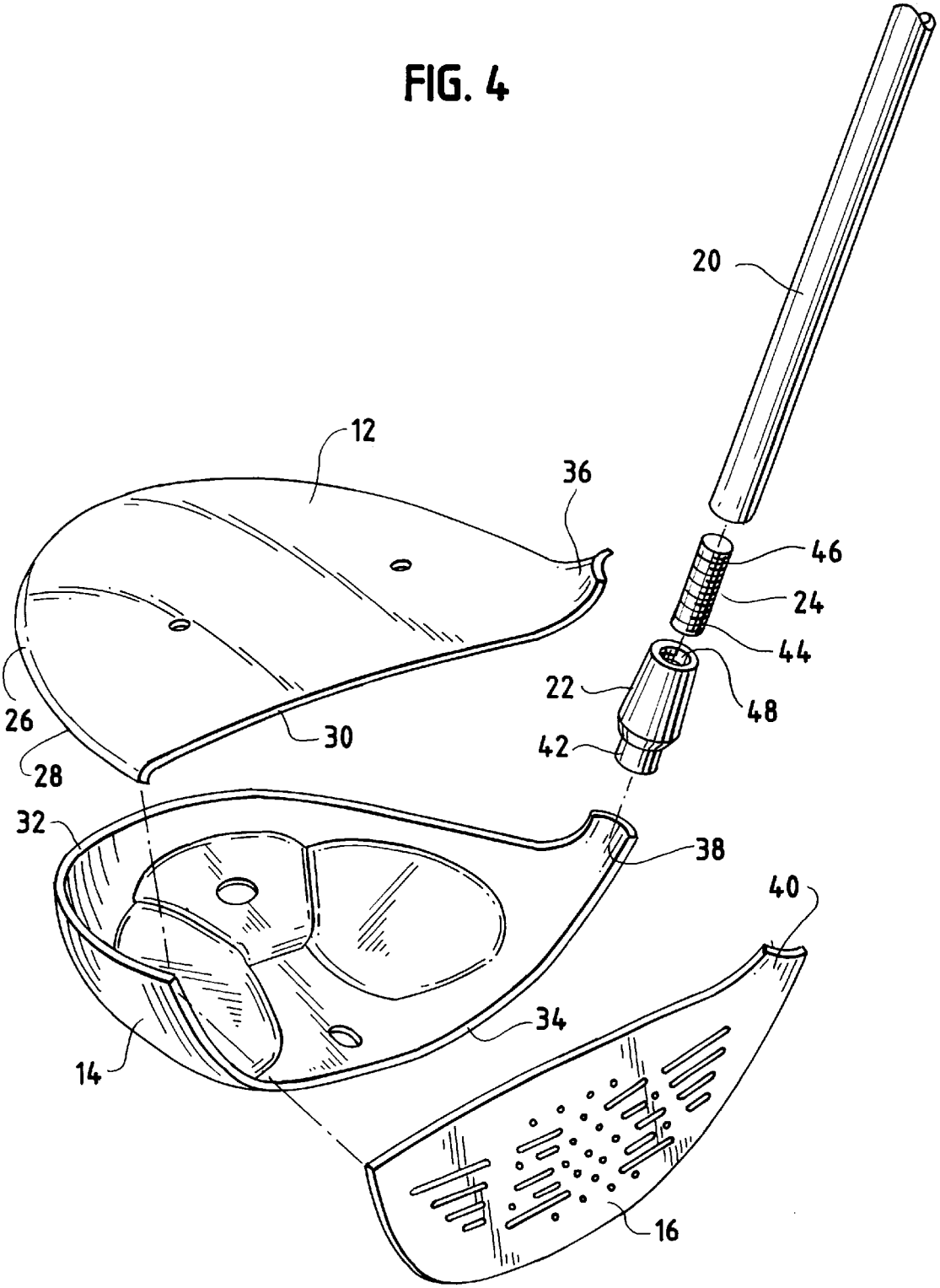

FIG. 4 comprises an exploded view of the various pieces of the club. As illustrated, the crown plate, the sole plate and the front plate define mating edges which permit welding of the pieces together. Specifically, the crown plate 12 defines side and rear downwardly depending walls 26 which terminate in the side and rear edges 28. A front edge 30 is also defined by the crown plate so that, in combination with its top wall, the crown defines an open bottom and an open front.

The upwardly extending side and rear walls of sole plate 14 define upper edges 32. These upper edges permit attachment to the edges 28 of the crown plate.

The front plate 16 has a rearwardly facing periphery with the top portion thereof permitting attachment to the edge 30 of the crown plate 12. The bottom and side walls of the sole plate 14 define front edges 34 which attach to the remaining peripheral portions of face plate 16.

The crown plate 12, at the heel end thereof, defines upwardly extending projection 36. Similar projections 38 and 40 are also formed at the heel ends of the sole plate 14 and front plate 16, respectively. Collectively, these projections define an opening receiving the hosel 22 when the plates are assembled. Specifically, the hosel defines a stem 42 which is secured, preferably by welding, within this opening as shown in FIGS. 2 and 3.

The stabilizing pin 24 defines threaded ends 44 and 46 for securing the shaft to the hosel. Specifically, the hosel defines threaded interior 48 for receiving pin end 44 and the shaft defines a corresponding threaded interior for receiving pin end 46.

As noted, a titanium alloy, for example, a forged 90% Ti—4% Va—6% Al alloy, is preferably employed for producing plates 12, 14 and 16. This relatively high strength material enables the formation of thin-walled plates, without reinforcing ribs or the like, so that a light golf club head is achieved. The hosel may be made of the same material or of a suitable stainless steel or other metal, and the shaft may be one of many suitable materials.

The plates and hosel are preferably welded together using standard techniques available for welding titanium alloy components, for example, high precision robotic systems. Adhesives may be used in combination with the threaded engagement of the hosel and shaft to enhance long-term stability.

The use of forged titanium plates achieves several advantages. Thus, the material is denser than cast titanium and has about 1.5 times the strength to weight ratio. There is also about 25 percent less energy loss at impact which translates to higher efficiency in play, particularly greater distance.

As noted, thin-walled plates, for example, a plate of about 2.9 mm. thickness may be used so that a light club results even with a larger dimension (i.e., "oversized") clubhead. With a lighter club, a golfer is more likely to be comfortable and to achieve a more efficient swing thereby taking maximum advantage of the aforesaid club characteristics. The forging process permits manufacturing tolerances within ±0.002 mm. thereby insuring that all clubs of the invention will have substantially the same characteristics.

The four-piece system described is especially suitable for precisely controlling weight distribution so that club balance, placement of the center of gravity, and "sweet spot" positioning, is readily achieved. Thus, each piece is separately produced to precision specifications and, when assembled, the desired weight distribution is automatically obtained.

The use of stabilizing pin 24 enhances the superior features of the four-piece structure. Thus, the pin perfectly centers and locks the shaft into place. This arrangement significantly reduces shaft vibration, improves torsional stability, and creates a superior feel of clubhead control.

It will be understood that various changes and modifications may be made in the described embodiments without departing from the spirit of the invention particularly as defined in the following claims.

I claim:

1. A metalwood golf club comprising a head and a shaft, said head consisting of a four-piece construction including:

a) a crown plate having a top wall defining a front edge, side edges and a rear edge;

b) a sole plate having a bottom wall and upwardly extending side and rear walls, upper edges of said side and rear walls attached to the respective side and rear edges of said crown plate, the combination of said sole plate bottom wall and said crown plate defining an open front for said head;

c) a front plate defining the ball-striking face of the head, front edges defined by said sole plate bottom wall and side walls, said front plate being attached to said crown plate and sole plate front edges; and d) a hosel attached to the assembly of the plate and wherein each of said crown plate, sole plate and front plate defines an upwardly extending projection at its heel end, the combination of said projections forming a juncture defining an opening receiving said hosel, said hosel being welded within said opening to each of said upwardly extending projections, said hosel defining one end extending within said opening and an opposite end extending outwardly from said juncture, a threaded interior defined by said opposite end, and means including said threaded interior securing a golf club shaft to said hosel.

2. A golf club according to claim 1 wherein said crown plate, sole plate and front plate are formed of a titanium alloy, and wherein these plates are welded together at said edges.

3. A golf club according to claim 2 wherein said titanium alloy plates comprise forged plates.

4. A golf club according to claim 1 including an externally threaded stabilizing pin having one end received within said threaded interior, said shaft defining a threaded interior, and the opposite end of said threaded pin being received within said threaded interior of said shaft.

* * * * *